US009403253B2

(12) United States Patent
Heide

(10) Patent No.: US 9,403,253 B2
(45) Date of Patent: Aug. 2, 2016

(54) METHOD AND APPARATUS FOR HANDLING SLABS FOR GRINDING THE SURFACES OF THE SLABS

(75) Inventor: Carsten Heide, Netphen (DE)

(73) Assignee: SMS LOGISTIKSYSTEME GMBH, Netphen (DE)

( * ) Notice: Subject to any disclaimer, the term of this patent is extended or adjusted under 35 U.S.C. 154(b) by 854 days.

(21) Appl. No.: 13/322,471

(22) PCT Filed: Aug. 6, 2010

(86) PCT No.: PCT/EP2010/004819
§ 371 (c)(1),
(2), (4) Date: Dec. 1, 2011

(87) PCT Pub. No.: WO2011/020566
PCT Pub. Date: Feb. 24, 2011

(65) Prior Publication Data

US 2012/0142256 A1 Jun. 7, 2012

(30) Foreign Application Priority Data

Aug. 18, 2009 (DE) ..... 10 2009 037 784
Jun. 26, 2010 (DE) ..... 10 2010 025 250

(51) Int. Cl.
*B24B 1/00* (2006.01)
*B24B 7/02* (2006.01)
(Continued)

(52) U.S. Cl.
CPC ... *B24B 7/02* (2013.01); *B24B 7/12* (2013.01); *B24B 27/033* (2013.01); *B21B 39/20* (2013.01)

(58) Field of Classification Search
CPC ..... B21B 39/20; B24B 27/033; B24B 7/02; B24B 7/12
USPC ..... 451/28, 177, 131; 164/263; 414/754
See application file for complete search history.

(56) References Cited

U.S. PATENT DOCUMENTS 1,508,378 A * 9/1924 Brown ..... 451/271
2,850,848 A * 9/1958 Boltz ..... 451/182
(Continued)

FOREIGN PATENT DOCUMENTS

DE 3834279 A 4/1990
DE 1087784 A 11/1997
(Continued)

*Primary Examiner* — Joseph J Hail
*Assistant Examiner* — Marc Carlson
(74) *Attorney, Agent, or Firm* — Andrew Wilford

(57) ABSTRACT

The invention relates to a method and an apparatus for handling slabs (2*a*, 2*b*), produced in particular by continuous casting, the surfaces of which are ground before they are rolled in a rolling train, wherein the slab, lying on a reversible grinding table (12*a*, 12*b*), is moved back and forth under a grinding unit, arranged in a machining cell, of a grinding machine unit (I, II), the grinding table is moved linearly out of the machining cell after the grinding operation has been performed on one surface, the slab is lifted off the grinding table and fed to a turning device, wherein, after turning, the slab is removed from the turning device and, with an unworked, other surface lying uppermost, is brought onto the grinding table, which is then introduced once again into the machining cell for the working of this surface. One aim of the invention is to provide a considerably simpler method and apparatus for handling continuously cast slabs during the grinding thereof, said apparatus having at the same time a much simpler construction. This is achieved by the slab being taken up by a slab manipulator (9), which has a rotatable slab clamping and lifting means (14; 14*a*, 14*b*) and with which the clamped slab can be both transported transversely and turned.

8 Claims, 7 Drawing Sheets

(51) Int. Cl.

| | |
|---|---|
| ***B24B 7/12*** | (2006.01) |
| ***B24B 27/033*** | (2006.01) |
| *B21B 39/20* | (2006.01) |

(56) References Cited

U.S. PATENT DOCUMENTS

| | | | | | |
|---|---|---|---|---|---|
| 3,006,116 | A | * | 10/1961 | Knost | 451/159 |
| 3,096,889 | A | * | 7/1963 | Vekovius et al. | 414/779 |
| 3,128,888 | A | * | 4/1964 | Di Lella | 414/431 |
| 3,472,397 | A | * | 10/1969 | Rhoads | 414/754 |
| 3,597,881 | A | * | 8/1971 | Olton et al. | 451/299 |
| 3,601,263 | A | * | 8/1971 | Stratton et al. | 451/365 |
| 3,796,011 | A | * | 3/1974 | Hopkins | 451/151 |
| 4,202,402 | A | * | 5/1980 | Rohrig | 164/263 |
| 4,262,733 | A | * | 4/1981 | Rohrig | 164/412 |
| 4,633,620 | A | | 1/1987 | Lorenzi | |
| 5,924,911 | A | * | 7/1999 | Br.ang.lander | 451/5 |
| 6,783,443 | B2 | * | 8/2004 | Pedrini | 451/167 |
| 8,657,651 | B2 | * | 2/2014 | Hofmann | 451/64 |
| 2001/0036792 | A1 | * | 11/2001 | Ferri et al. | 451/5 |
| 2003/0092359 | A1 | * | 5/2003 | Pedrini | 451/5 |
| 2003/0188997 | A1 | * | 10/2003 | Tan et al. | 209/538 |
| 2003/0198551 | A1 | * | 10/2003 | Schmidt et al. | 414/749.1 |
| 2004/0209557 | A1 | * | 10/2004 | Gariglio | 451/44 |
| 2007/0240698 | A1 | * | 10/2007 | Holbrook | 126/25 R |
| 2011/0281505 | A1 | * | 11/2011 | Hofmann et al. | 451/28 |
| 2012/0142256 | A1 | | 6/2012 | Heide | |
| 2012/0258650 | A1 | * | 10/2012 | Hofmann | 451/64 |

FOREIGN PATENT DOCUMENTS

| | | | |
|---|---|---|---|
| GB | 2223432 | A | 4/1990 |
| JP | 200288889 | A | 10/2000 |

* cited by examiner

METHOD AND APPARATUS FOR HANDLING SLABS FOR GRINDING THE SURFACES OF THE SLABS

CROSS REFERENCE TO RELATED APPLICATIONS

This application is the US-national stage of PCT application PCT/EP2010/004819 filed 6 Aug. 2010, published 24 Feb. 2011 as WO2011/020566, and claiming the priority of German patent application 102009037784.0 itself filed 18 Aug. 2009 and German patent application 102010025250.6 itself filed 26 Jun. 2010.

FIELD OF THE INVENTION

The invention relates to a method and an apparatus for handling slabs, in particular, those produced by continuous casting, where the faces of the slabs are ground in a rolling mill train before rolling, and the slab lying on a reversing grinding table is moved back and forth under a grinding assembly of a grinding machine disposed in a grinding cabin, the grinding table being moved in a straight line out of the grinding cabin after the grinding of its face, the slab being raised from the grinding table and delivered to a turner, and where after being turned the slab is removed from the turner and transferred to the grinding table with the other unworked face facing up, the table then returning into the grinding cabin to allow machining of this face.

A typical approach in practice in particular is to have the wide and optionally also the narrow sides of the slabs ground before rolling in a rolling mill train according to the above-indicated procedure, which slabs have been continuously cast and cut to the desired length In order to convey and turn the slabs, the equipment employed for this purpose requires numerous mechanical parts and large complex hydraulics—in particular, in addition to the turners and conveyor equipment that receive the continuously cast workpiece and deliver it to the immediately following working station, or that maintain the flow of material. This is because cross-conveyor or low-profile trolleys running on rails must first be moved onto the grinding table, which then also must be equipped with rails for this purpose, thereby resulting in a heavy design capable of removing the slab raised by hydraulic supports from the grinding table. The multiple cross-conveyor trolleys running side-by-side in parallel on separate rails then transfer the received slab to a stationary slab-turner, for example a tilting cradle. The slab turned here is positioned in a stationary slab-holding zone, raised off it by the cross-conveyor trolley, and conveyed back onto the grinding table.

OBJECT OF THE INVENTION

The object of this invention is therefore to provide a significantly simplified method and apparatus to effect handling during the grinding of continuously cast slabs, while simultaneously having significantly reduced mechanical complexity.

SUMMARY OF THE INVENTION

This object is achieved by a method according to the invention in which the slab is moved by a slab manipulator including a rotating slab clamping and lifting means that serves to both convey and turn the gripped slab. This thus allows all relevant functions of conveying, raising, lowering, clamping, and turning the slabs to be integrated into one assembly, specifically the multifunction slab manipulator, that is programmed for this purpose from a central controller.

A preferred embodiment of the invention provides an approach whereby the slab, which has been positioned on the grinding table, has been temporarily held in a stationary holding zone, or has been delivered by a roller conveyor, can be engaged by a slab manipulator that is moved up from a starting position, that is laterally offset from and parallel to the slab, and that grasps the slab with opened slab clamping and lifting means, after which the slab clamping and lifting means is closed and the slab manipulator with the gripped slab is moved to a turning station in which the slab is rotated by the slab clamping and lifting means, and the slab clamping and lifting means is then moved over the grinding table, whereupon the slab clamping and lifting means is lowered until the slab rests on the grinding table and is then opened, and, after depositing the slab, the slab manipulator is moved into its starting position laterally offset to a position parallel to another slab. Nothing changes in the sequence if the slab is deposited for temporary holding in a holding zone instead of being deposited immediately on the grinding table.

The result preferably achieved is that the slab manipulator can be transversely moved as desired between at least one available grinding table, one or more stationary slab-holding zones, or the turning station, or optionally a roller conveyor to receive a slab to be ground, or to allow removal of the completed ground slab. The multifunction slab manipulator, whose substructure can be constructed of concrete for the running track or rails of the cross conveyor, thus performs all logistical functions.

A continuous grinding operation and continuous loading of a slab to be worked into the grinder not momentarily grinding can be ensured when operating preferably two grinding machines situated adjacent each other at a certain spacing, while temporarily holding them in slab-holding zones. When in the starting position of the conveying and turning cycle, the slab is thus located either on a grinding table or in a stationary slab-holding zone. When in the turning station between, for example, two stationary slab-holding zones and/or the grinders, the slab manipulator has sufficient clearance to pivot the slab 180° to allow grinding of the wide faces.

An apparatus according to the invention, in particular, one to implement the method, provides an approach wherein at the outlet end of at least one grinder in which the grinding table has been longitudinally moved with the slab resting thereon, a slab manipulator is provided that is movable transversely thereto, the manipulator having a traveling frame with synchronously driven turning mechanism frames on each side, the traveling frame spanning the length of the grinding table, wherein the turning mechanism frames are each linked to each other through one upper and one lower lifting cross-member that are raisable and lowerable in the turning mechanism frames, and wherein the one lifting cross-member is provided with support elements that extends under the lower slab face while the other lifting cross-member is provided with support elements that extend over the upper slab face. Once the slab has been received between the two lifting cross-members, the lower support element carries the slab while it is clamped and gripped by moving down the other support element.

In order to effect the vertical adjustment of the lifting cross-members extending over and under the slab, these cross-members are linked to the turning mechanism frame preferably by hydraulic cylinders, and are also advantageously mounted on guides of the turning mechanism frames.

In a preferred proposed approach of the invention, the lifting cross-members are raisable and lowerable independently of each other. When in the holding position, only one of the lifting cross-members thus has to be lowered and then moved under the slab coming from the side until the narrow side of the slab contacts a stop advantageously provided on the lifting cross-members. The lower lifting cross-member is then raised while the upper lifting cross-member is lowered only at a later point to clamp and grip the slab. After the turning procedure, the lower lifting cross-member takes over the function of the upper lifting cross-member, then once again visa versa.

Turning the slab can be advantageously done by providing the turning mechanism frames with a pivotal mount for the traveling frame, the pivotal mount being operated by a rotary drive. A geared motor is preferably employed as the rotary drive.

In another proposed approach according to the invention, the lifting cross-members are provided with prong-like support rods as support elements that are offset relative to each other in the longitudinal direction of the cross-member. Holding, as well as clamping or gripping the slab is effected here by linear contact faces and support elements that are offset at the top and bottom along the length of the slab.

To this end, the invention provides an approach whereby the support rods overlap each other and extend beyond half the maximum slab width and beyond the minimum slab width. The width of this type of slab to be manipulated can be, for example, 800 mm up to 1700 mm, with a length of 5000 mm up to 12,000 mm, and thicknesses of 150 mm up to 240 mm.

The prong-like support rods of the lower and upper lifting cross-members are consequently of a length that enables any slab appearing the intended width spectrum to be reliably received, clamped, and turned.

BRIEF DESCRIPTION OF THE DRAWING

Additional details and advantages of the invention are revealed in the claims and following description in which an embodiment of the invention, which is illustrated in the figures, is described more fully. Therein:

SPECIFIC DESCRIPTION OF THE INVENTION

Figure 6:
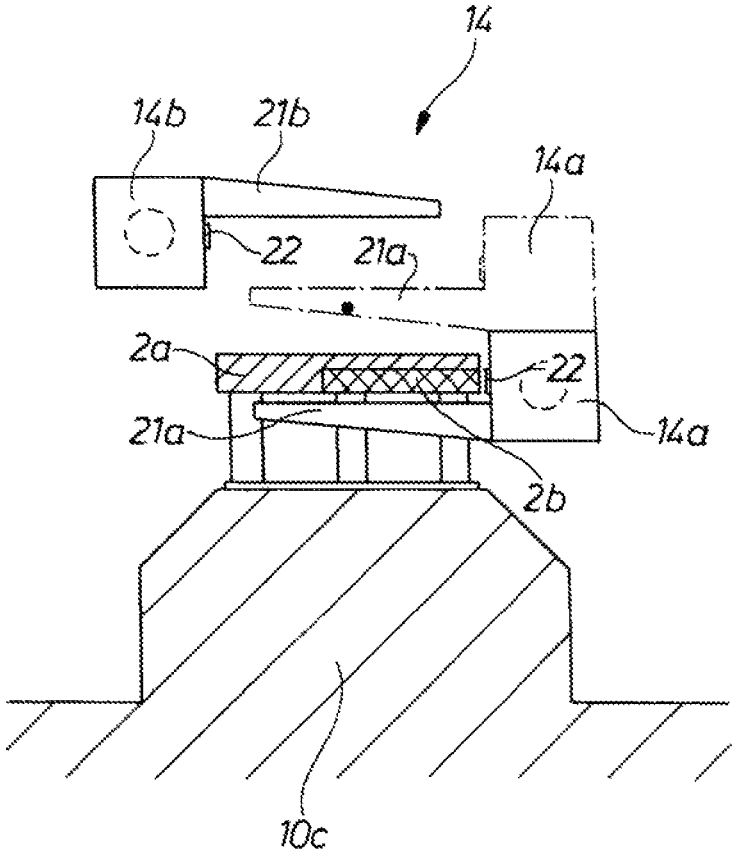
FIG. 6 is a schematic side view in the form of a detail of the slab manipulator, the manipulator's upper and lower lifting cross-members while extending across a grinding table loaded with a slab, or across a stationary slab-holding zone and after lowering the dashed-line lower lifting cross-member when holding the slab.
Figure 6A:
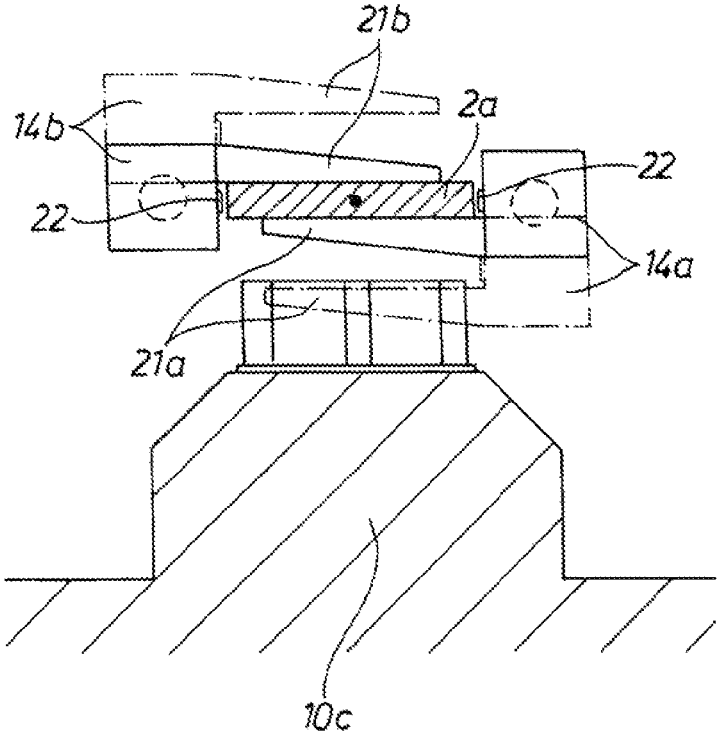
FIG. 6*a* is a diagram corresponding to FIG. 6 after the upper lifting cross-member has been lowered and thus grips a slab of maximum width dimension.
Figure 6B:
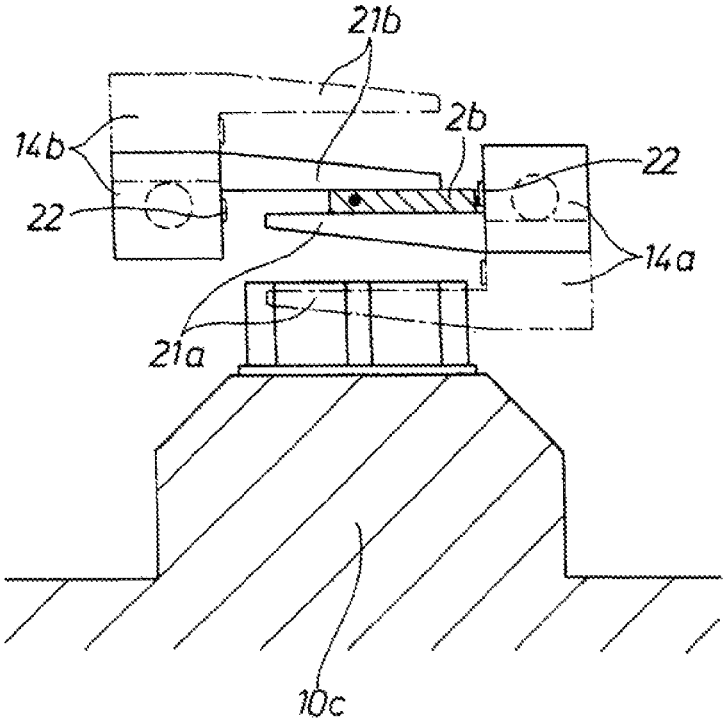
FIG. 6*b* is a diagram corresponding to FIG. 6 for a slab of minimum width and thickness.

Two grinders I and II are downstream of a cross conveyor 3 in the material travel direction shown by arrow 1 for handling slabs 2*a* or 2*b* to be ground, the slab 2*a* being of maximum width and thickness (see FIG. 6*a*) while the slab 2*b* is of minimum width and thickness (see FIG. 6*b*). The cross conveyor 3 has a slab manipulator 9 supported by wheels 4 on a substructure 6 fixed on a floor 5 and extending transversely in the direction of the double arrow 8 transversely to the grinders I and II, the substructure 6 having, for example, concrete-supported tracks 7*a* and 7*b* (see FIG. 3).

Figure 2:
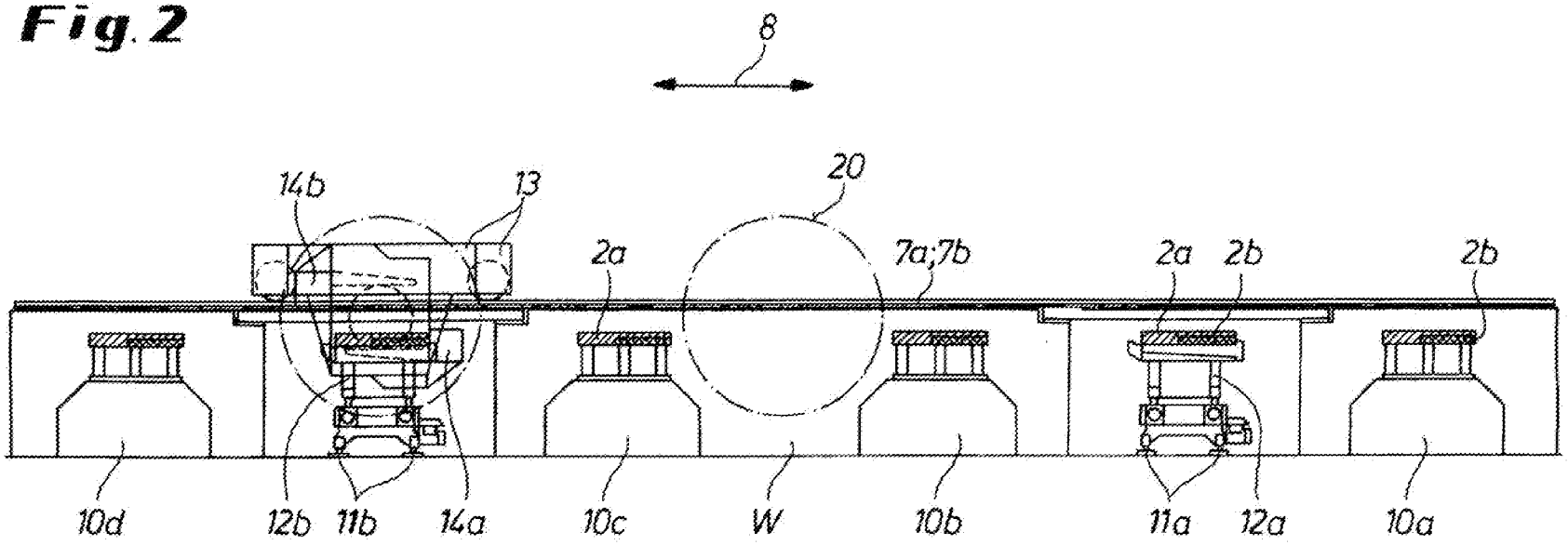
FIG. 2 is a schematic side view of the cross conveyor including the slab turner of FIG. 1.
Figure 3:
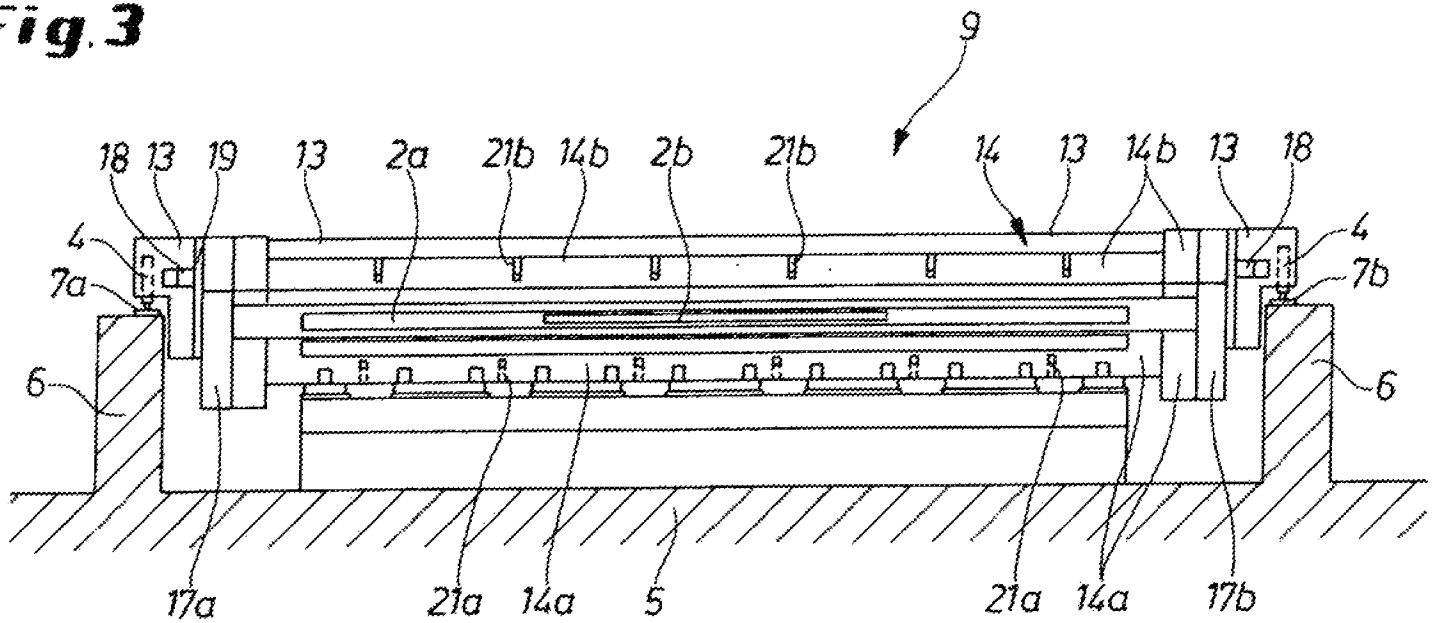
FIG. 3 is an end view of the slab manipulator of FIGS. 1 and 2 in the form of a cross conveyor and slab turner.

In the embodiment of FIGS. 2 and 3, the cross conveyor 3 has holding zones 10*a*, 10*b*, 10*c*, and 10*d* that are parallel, spaced transversely, and adjacent each other, and two floor-mounted two-rail tracks 11*a* and 11*b* each extend longitudinally in the material travel direction 1 between a respective pair of the two outer slab-holding zones 10*a* and 10*b* or 10*c* and 10*d*. Grinding tables 12*a* and 12*b* are longitudinally movable on these tracks and convey a slab to be worked or ground into the grinders I or II, or move it out to turn the slab to allow grinding of its other face.

Figure 1:
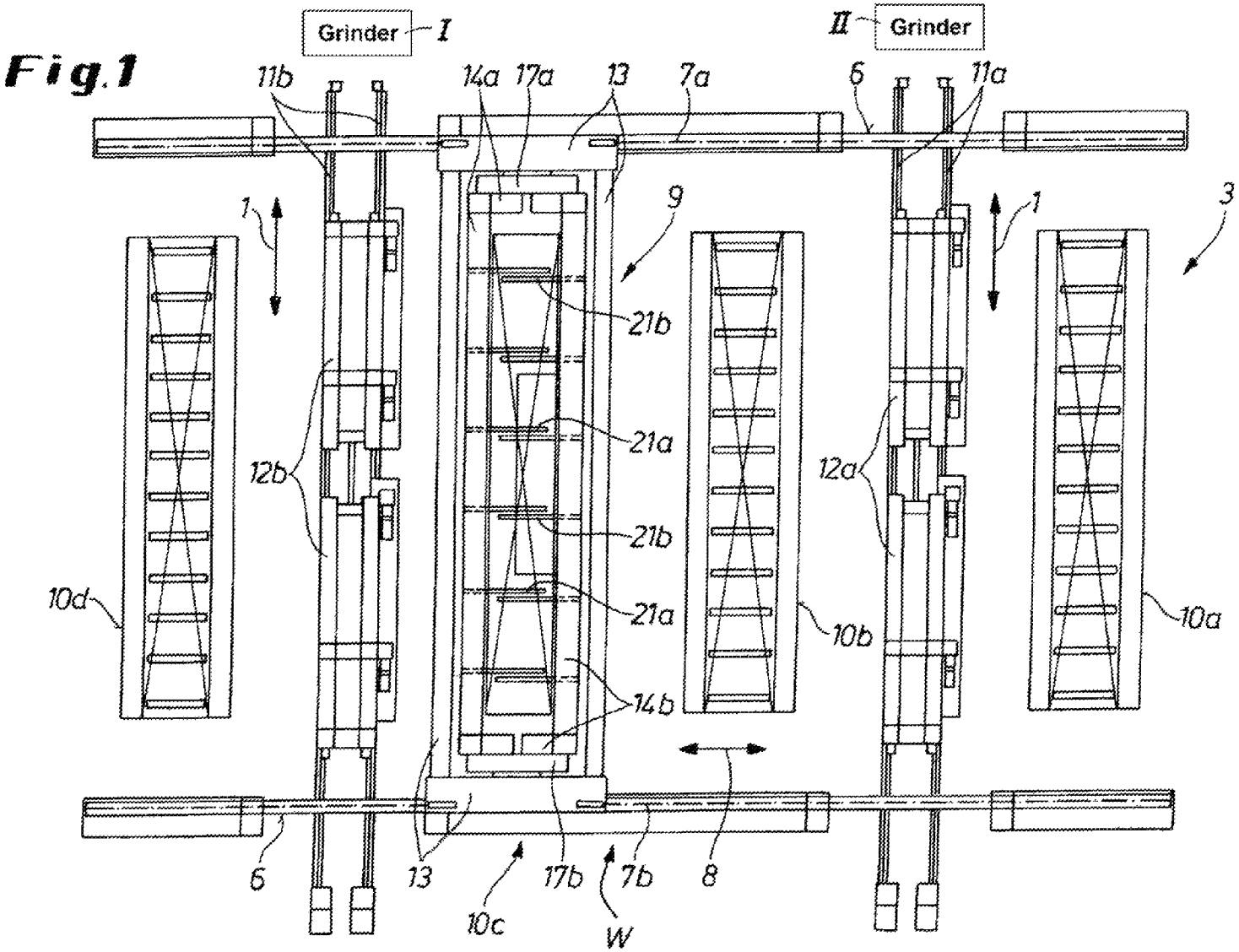
FIG. 1 is a schematic top view of a cross conveyor that is adjacent two grinders I and II side-by-side relative to each other at a certain spacing and that includes an integrated turner to manipulate slabs to be ground.
Figure 4:
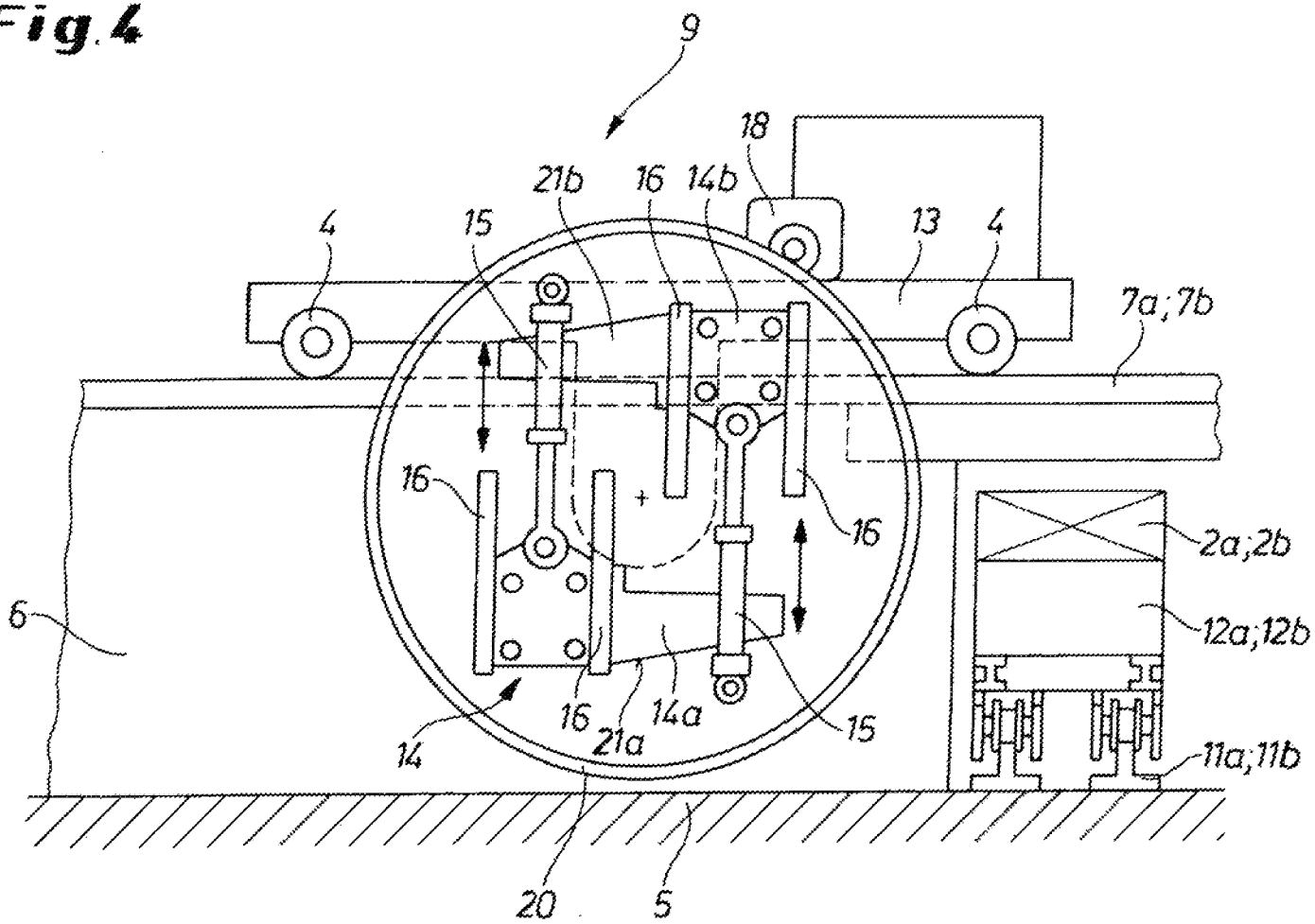
FIG. 4 is a side detail view providing an elementary diagram illustrating the functions of the slab manipulator.
Figure 5:
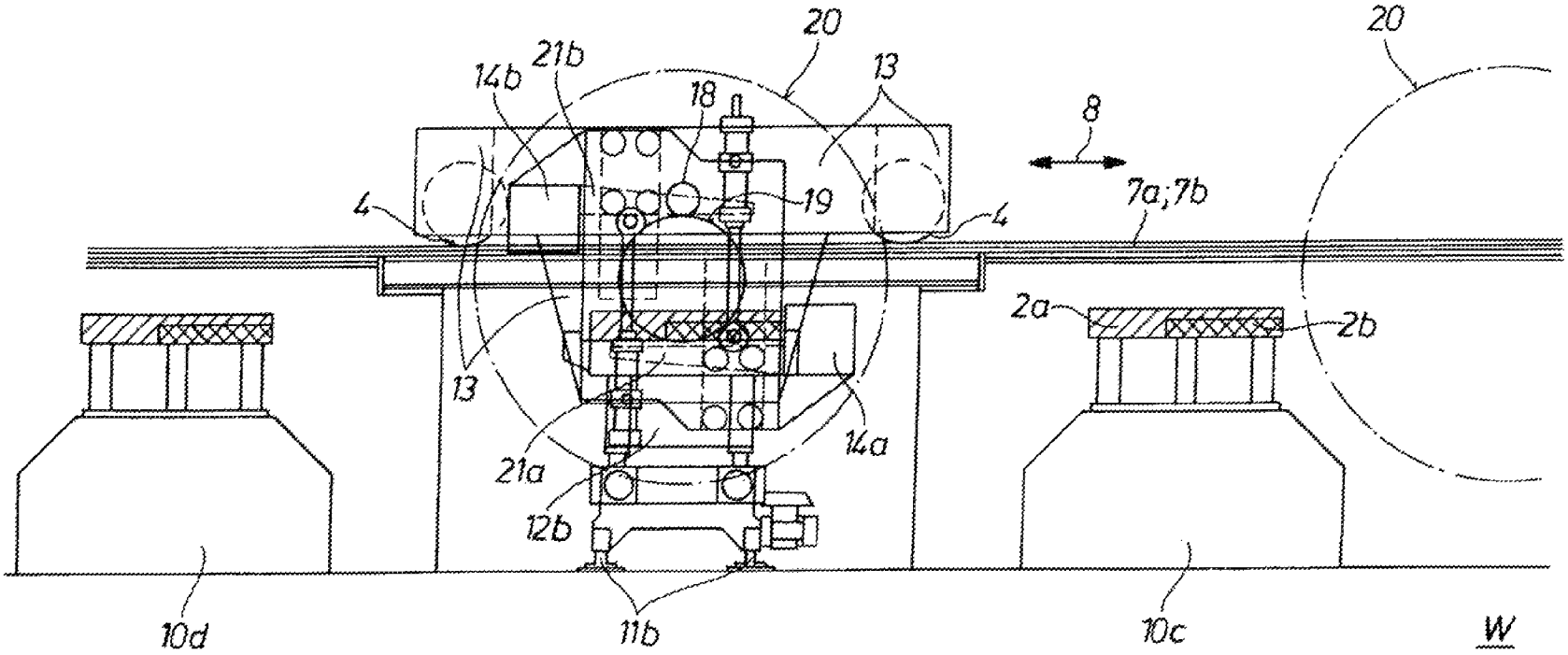
FIG. 5 is a side view providing a detailed diagram of the slab manipulator of FIG. 4.

The slab manipulators 9 each have a circumferentially closed traveling frame 13 that spans the respective substructure 6 with the two tracks 7*a* and 7*b* (see FIGS. 1 and 3). Slab clamping and lifting means 14 are provided in each of the manipulators 9 in the form of a lower lifting cross-member 14*a* and a upper lifting cross-member 14*b* that can be raised and lowered independently of each other in respective guides 16 by respective hydraulic cylinders 15 (see FIG. 4). In order to turn a received and gripped one of the slabs 2*a* or 2*b*, the clamping and raising means 14 are capable of rotating to which end the lower as well as the upper lifting cross-members 14*a* or 14*b* are supported at their respective two ends in a respective pivotable frame 17*a* or 17*b* that is carried by the traveling frame 13 (see FIG. 3). The turning frames 17*a*, 17*b* are provided with a ball mount 19, shown schematically in FIG. 5, linked to the traveling frame 13 and operable by a rotary drive 18, in particular, a geared motor. The orbit of the slab manipulator 9 is indicated in FIGS. 2 and 5 as a dot-dash circle 20 (see also FIG. 4).

The upper and lower lifting cross-members 14*a* and 14*b* are provided with respective prong-like support rods 21*a* and 21*b* serving as supporting and holding elements. The support rods 21*a* of the lower lifting cross-member 14*a* are offset in the longitudinal direction of the cross-member relative to the support rods 21*b* of the upper lifting cross-member 14*b* (see FIG. 1).

In the starting position of the conveying and turning cycle, the slab 2*a* or 2*b* is either on the grinding table 12*a* or 12*b*, or in one of the holding zones 10*a*, 10*b*, 10*c*, or 10*d*. The slab manipulator 9 can travel transversely in the direction 8 on the substructure 6 as desired over the respective slab-holding zones 10*a* through 10*d*, and the grinding tables 12*a*, 12*b* effect the desired distribution of the slabs. In order to pick up a slab, the slab manipulator 9 is moved with spread cross-members 14*a* and 14*b* into a position parallel to the holding zone 10*a* through 10*d*, or to the grinding table 12*a* or 12*b* as illustrated in FIG. 1 in the position for the grinding table 12*b*.

As soon as the slab manipulator 9 has moved to adjacent a grinding table or a stationary slab-holding zone, and is in a position parallel thereto as shown in FIGS. 6 and 6*a* or 6*b*, the lower lifting cross-member 14*a* is lowered from the broken-line raised position and then the slab manipulator 9 is moved under the slab 2*a* or 2*b* sitting in the embodiment of FIG. 6 in the holding zone 10*c*, as shown by the solid lines. The transverse travel by the slab manipulator 9 to extend under the slab is terminated as soon as the slab 2*a* or 2*b* engages a stop 22 of the lifting cross-member 14*a*.

The lower lifting cross-member 14*a* underneath the slab is then raised, after which the upper lifting cross-member 14*b* is lowered down to grip the slab as illustrated in FIG. 6*a* for the slab 2*a* of maximum dimensions, and in FIG. 6*b* for the slab 2*b* of minimum dimensions. In order to turn, the slab manipulator 9 is moved transversely in the direction 8 into a turning station W providing sufficient clearance, as indicated in FIG. 2, between two slab-holding zones 10*b* and 10*c* (see also FIG. 5). After turning, the lower lifting cross-member 14*a* assumes the function of the upper lifting cross-member 14*b*, and vice versa. The slab 2*a* or 2*b* thus turned can then be moved transversely and deposited in the slab-holding zones 10*a* through 10*d* for temporary holding, or immediately positioned on the grinding table 12*a* or 12*b* that moves the slab into the grinder I or II for grinding with the face for grinding turned up.

The invention claimed is:

1. A slab-grinding apparatus comprising:

a grinder;

a longitudinally shiftable grinding table aligned longitudinally in a travel direction with the grinder for longitudinally feeding a slab having opposite faces to be ground into the grinder and for moving a ground slab longitudinally back out of the grinder;

a rigid traveling frame spanning a longitudinal length of the table, having opposite longitudinal ends, and shiftable transversely of the direction between a position at least partially above the grinding table and a holding station transversely adjacent the grinding table;

a rotary mount having turning frames each carried by a respective one of the longitudinal ends of the traveling frame and rotatable on the traveling frame about a common longitudinally extending axis;

a clamp having transversely projecting upper and lower cross-members suspended from the turning frames and movable on the turning frames radially of the axis toward and away from each other to engage respectively over and under the slab on the table for picking the slab up off the grinding table and moving the picked-up slab to the holding station;

drive means for shifting the traveling frame with the clamp and the rotary mount transversely between the holding station and the grinding table after the clamp has picked up the slab off the grinding table to thereby move the clamp and the picked-up slab to the holding station, and turn the clamp and picked-up slab over by rotating the clamp on the mount, and then move back the clamp and turned-over and picked-up slab to above the grinding table for depositing the turned-over slab thereon.

2. The apparatus according to claim 1, wherein the cross members are support rods that overlap each other and extend beyond half a maximum slab width and beyond a minimum slab width.

3. The apparatus according to claim 1, wherein the lifting cross-members are mounted in guides on the turning frames.

4. The apparatus according to claim 1, wherein the lifting cross-members include a stop that the slab contacts with its narrow side.

5. The apparatus according to claim 1, further comprising:

hydraulic cylinders of the turning frames that are linked to the lifting cross-members to vertically shift them.

6. The apparatus defined in claim 1, wherein the upper cross-members are longitudinally offset from the lower cross-members.

7. A slab-grinding apparatus having a pair of grinders offset from each other transverse to a longitudinal travel direction;

respective table conveyors shiftable longitudinally in the travel direction between the grinders between respective holding stations longitudinally offset from the grinders and transversely spaced from each other for longitudinally displacing slabs having opposite faces to be ground between the grinders and the respective holding stations;

a rigid traveling frame spanning a longitudinal length of the tables, having opposite longitudinal ends, and shiftable transversely of the direction between the holding stations and the respective tables;

a respective rotary mount having respective turning frames each carried by a respective one of the longitudinal ends of the respective traveling frame and rotatable on the traveling frame about a common longitudinally extending axis;

a clamp having transversely projecting upper and lower cross-members suspended from the turning frames and movable thereon radially of the respective axis toward and away from each other to engage respectively over and under the slab on the respective table for gripping the slabs on the table conveyors in the holding stations;

respective drive means for shifting the traveling frames with the respective clamps and the respective rotary mounts transversely between the respective tables and stations so the clamp can pick one of the slabs up off one of the respective table, move into the respective holding station, turn the picked-up slab over in the respective holding station, and then deposit the turned-over slab back onto the respective table.

8. The apparatus defined in claim 7 wherein each clamp includes upper clamp rods and lower clamp rods movable diametrally of the respective axis toward and away from each other.

* * * * *